US005097561A

United States Patent [19]

Torres

[11] Patent Number: 5,097,561

[45] Date of Patent: Mar. 24, 1992

[54] WRINGER MOP WITH AUXILIARY CLEANING ELEMENTS

[75] Inventor: Bonifacio Torres, Mattson, Ill.

[73] Assignee: M. B. Walton, Inc., Chicago, Ill.

[21] Appl. No.: 133,507

[22] Filed: Dec. 16, 1987

[51] Int. Cl.[5] ..... A47L 13/144

[52] U.S. Cl. ..... 15/119 A; 18/116.2

[58] Field of Search ..... 15/119 A, 119 R, 116.1, 15/116.2

[56] References Cited

U.S. PATENT DOCUMENTS

| | | | |
|---|---|---|---|
| 603,999 | 5/1898 | Ballam . | |
| 1,424,291 | 8/1922 | Frank . | |
| 1,818,917 | 8/1931 | Wolf . | |
| 2,251,384 | 8/1941 | Thomas . | |
| 2,683,886 | 7/1954 | Neumann . | |
| 2,722,701 | 1/1955 | Blum | 15/119 A |
| 2,858,557 | 11/1958 | Zottola . | |
| 2,892,201 | 6/1959 | Peterson et al. | 15/244.2 |
| 2,916,754 | 12/1959 | Zottola . | |
| 3,097,384 | 7/1963 | Clark . | |
| 3,345,667 | 10/1967 | Blum . | |
| 3,495,289 | 2/1970 | Heid . | |
| 3,721,502 | 3/1973 | Ognibene . | |
| 3,727,259 | 4/1973 | Wilson . | |
| 3,795,933 | 3/1974 | Seufert . | |
| 4,196,488 | 4/1980 | Barry . | |
| 4,333,198 | 6/1982 | Vosbikian | 15/119 A |
| 4,455,705 | 6/1984 | Graham . | |
| 4,464,807 | 8/1984 | Weiss . | |
| 4,481,688 | 11/1984 | Graham . | |
| 4,491,988 | 1/1985 | Wilson et al. . | |
| 4,516,287 | 5/1985 | Johnson et al. | 15/119 A |
| 4,524,484 | 6/1985 | Graham . | |
| 4,604,767 | 8/1986 | Burkhart et al. . | |

FOREIGN PATENT DOCUMENTS

| | | | |
|---|---|---|---|
| 1125604 | 3/1962 | Fed. Rep. of Germany | 15/119 A |
| 1162293 | 4/1958 | France | 15/116.2 |
| 684991 | 3/1965 | Italy | 15/119 A |
| 664440 | 1/1952 | United Kingdom | 15/119 A |
| 721289 | 1/1955 | United Kingdom | 15/119 A |
| 994780 | 6/1965 | United Kingdom | 15/119 A |

OTHER PUBLICATIONS

Photographs of "Roll-O-Matic", commercially available mop distributed by M. B. Walton, Inc., no date.

*Primary Examiner*—Harvey C. Hornsby
*Assistant Examiner*—Stephen F. Gerrity
*Attorney, Agent, or Firm*—Wood, Phillips, Mason, Rectenwald & Van Santen

[57] ABSTRACT

A wringer mop with auxiliary cleaning elements is disclosed. The wringer mop includes a mop head having a mounting member disposed at its center. The mop head is mountable on an operating rod by turning the mop head about its central vertical axis. Once mounted, the mop head is held in place by sets of wringer rollers. The wringer mop also includes a mop head housing having projections extending into the interior of the mop handle to limit lateral movement of the operating rod. The mop head housing is strengthened by channel-defining walls. Auxiliary cleaning elements and a bracket for mounting the auxiliary cleaning elements are also disclosed.

5 Claims, 2 Drawing Sheets

WRINGER MOP WITH AUXILIARY CLEANING ELEMENTS

BACKGROUND OF THE INVENTION

The present invention concerns wringer mops, and more particularly, wringer mops of the type having an operating rod extending through a hollow mop handle to connect to a mop head, the operating rod being moveable axially to pull the mop head through wringer rollers, and to be pushed to a position where the mop head may be removed and a replacement mop head mounted.

Wringer mops are well known in the art. In some types of wringer mops, two operating rods on the exterior of the mop handle are used to pull the mop head through sets of wringer rollers to expel fluid from the sponge of the mop head. In other types of wringer mops, a single operating rod extends through the hollow handle of the mop to connect to the mop head. These types of mops generally include a ring insert placed within the handle to limit lateral movement of the rod within the handle.

Various means of connecting the mop head to the end of the operating rod have been proposed by the art. For example, in U.S. Pat. No. 4,481,688 to Graham, the mop head is hooked onto the end of a single operating rod by changing the angular position of the mop head and slipping the end of the operating rod into a tunnel formed in the mop head. In U.S. Pat. No. 4,196,488 to Barry, the spine of the mop head is engaged by a bail formed at the end of a single operating rod, and lateral movement of the mop head is prevented by keyways formed in the spine engaged by walls of the mop head housing. Other variations in floor mops and in means for wringing out the mops are disclosed in U.S. Pat. No. 4,464,807 to Weiss and in U.S. Pat. No. 3,495,289 to Heid.

It has also been suggested in the art to attach additional cleaning elements to floor mops. For example, U.S. Pat. No. 4,604,767 to Burkhart et al., discloses a wringer mop with a scrubber attachment that moves forwardly into working position when the sponge is in the squeeze out or wringing position.

The use of squeegees for cleaning windows is known, as disclosed in U.S. Pat. No. 3,721,502 to Ognibene.

SUMMARY OF THE INVENTION

The disclosed wringer mop comprises an elongate handle having a longitudinal opening within the handle's interior extending from the handle's medial portion to the lower end of the handle. An elongate operating rod extends through the opening within the handle, and has an upper end disposed at the medial portion of the handle. The operating rod extends downwardly from its upper end through the longitudinal opening in the interior of the handle and terminates at a lower connecting end extending outwardly from the lower end of the mop handle. A mop head housing is fixed at the lower connecting end of the mop handle. The mop head housing includes a pair of mating shells, each shell having an upper portion defining a partial socket for the captive retention of the lower end of the mop handle between the two shells. Each shell also has bifurcated end walls forming apertured support legs at their lower ends. A set of parallel axles extends through the apertures of the support legs of the shells. First and second sets of spaced wringer rollers are supported on the axles of each shell, the two sets of spaced rollers being parallel to each other and defining an elongate passageway therebetween.

The wringer mop also includes a replaceable mo head including an elongate sponge and an elongate spine defining a channel in which a portion of the elongate sponge is held. The elongate sponge has a cleansing portion exposed beyond the spine. A mounting member extends upwardly from the center of the spine, and has an apertured face disposed transversely to the longitudinal channel. When the mop head is mounted, the lower connecting end of the operating rod extends through the aperture in the face of the mounting member. This construction provides for demountably attaching the mop head to the operating rod.

The wringer mop also includes operating means associated with the upper end of the operating rod for pushing the rod downwardly for mounting and removing the mop head and for pulling the rod upwardly so that the cleansing portion of the sponge is pulled between the set of spaced wringer rollers to expel fluid from the sponge.

The connecting end of the wringer mop's operating rod is shaped so that the mop head is mountable by placing the end of the operating rod through the aperture in the face of the upstanding mounting member and turning the mop head about its vertical axis until the mop head's longitudinal channel is parallel to the sets of spaced rollers, and thereafter pulling the operating rod until the sides of the spine are positioned between the sets of spaced rollers thereby preventing the mop head from turning about its vertical axis. The mop head is similarly removable, by pushing the operating rod downwardly until the spine is free of the sets of wringer rollers, turning the mop head about its central vertical axis, and removing the connecting end of the operating rod from the aperture of the mounting member.

The wringer mop also includes projecting means extending from each shell of the mop head housing into the longitudinal opening in the interior of the handle, the two projecting means serving to limit the lateral movement of the operating rod within the longitudinal opening of the mop handle. The mating shells of the mop head housing have side walls, and may include channel-defining walls along the edges of the side walls to strengthen the housing. With the housing so strengthened, the length of the housing may be increased to accommodate larger sponges.

The wringer mop may also include an auxiliary cleaning element and a bracket for mounting the auxiliary cleaning element on the mop head housing. The bracket includes apertured members through which one of the axles extends, for mounting the bracket on the axle, and a forked retaining member capturing the lower edge of the shell side wall between the prongs of the fork to maintain the position of the bracket on the axle. The bracket also includes means for holding the auxiliary cleaning element. The auxiliary cleaning element may be a squeegee, a scrubbing brush or other cleaning element, to enhance the utility of the wringer mop. The auxiliary cleaning element may be affixed to the bracket or the bracket may be constructed so that different auxiliary cleaning elements may be interchanged.

The disclosed wringer mop thus provides a unique means for attaching the mop head to the operating rod involving turning the mop head about its central vertical axis, and relying on the sets of wringer rollers to maintain the mop head on the operating rod by preventing rotation of the mop head once it is in the working position. The disclosed mop head also eliminates the need for a separate piece within the handle to limit the lateral movement of the operating rod; this function is accomplished by projections extending from the mop head housing into the interior of the handle. The disclosed wringer mop also provides for auxiliary cleaning attachments mounted for use on the axle carrying the wringer rollers.

DETAILED DESCRIPTION OF THE ILLUSTRATED EMBODIMENT

Figure 1:
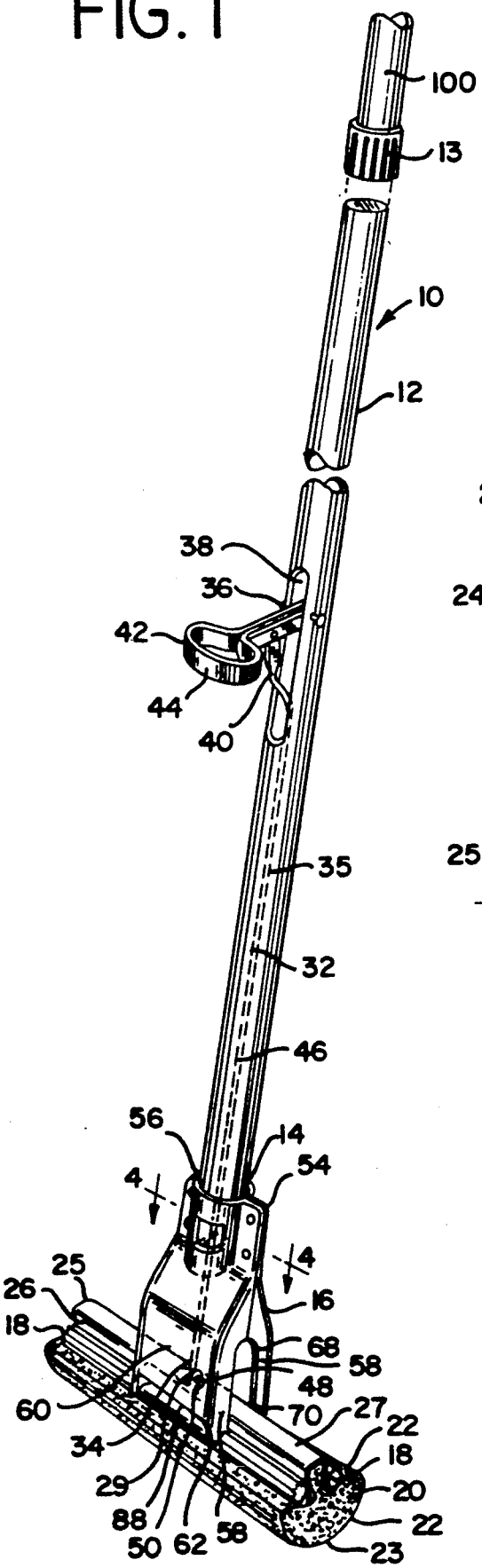
FIG. 1 is a perspective view of the wringer mop of the present invention.

As shown in the accompanying drawings, the wringer mop 10 of the illustrated embodiment of the present invention generally includes a hollow elongate handle 12, with a cap 13 at its upper end, and held at its lower end 14 by a mop head housing 16. The mop head housing 16 includes spaced sets of parallel wringer rollers 18. The wringer rollers are provided to squeeze excess or soiled fluid from a sponge 20 of a replaceable mop head 22.

Figure 2:
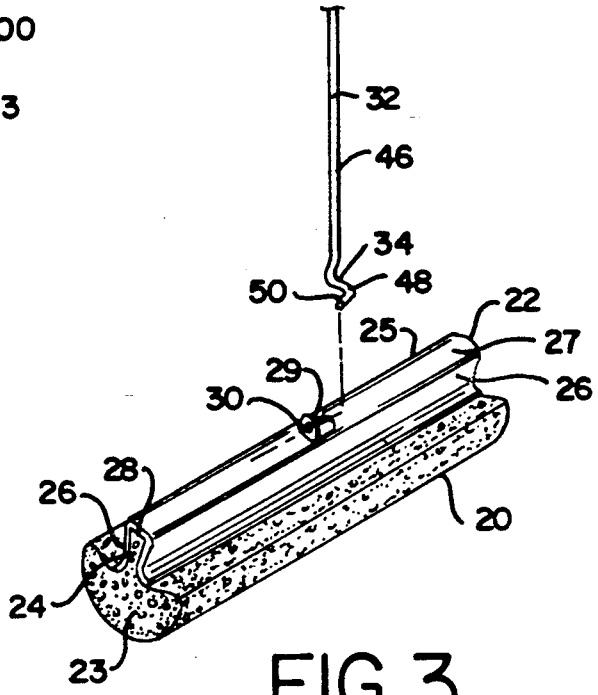
FIG. 2 is a exploded perspective view of the mop head and part of the operating rod of the present invention.

As shown in FIG. 2, the mop head 22 has an elongate sponge 20 with an exposed cleansing portion 23 and an upper portion 24 held by a channel-defining spine 25. The spine 25 has side walls 26 and a top surface 27 defining the longitudinal channel 28 which holds the upper portion 24 of the sponge 20. The spine 25 also has a mounting member 29 for mounting the replaceable mop head. As shown in FIG. 2, the illustrated mounting member 29 extends upwardly from the center of the top surface 27 of the spine 25 and has an apertured face 30 disposed transversely to the longitudinal channel 28 of the spine 25. In the illustrated embodiment, the spine is made of metal, with the mounting member partially cut out and bent upwardly from the top of the spine.

The sponge 20 is held by the compressive forces exerted by the walls of the spine 25. To increase the grip of the side walls 26 against the upper portion 24 of the sponge, inwardly-bent gripping fingers may be formed in the side walls.

It may also be desirable to include additional mounting fixtures on the spine, so that replacement mop heads may be used on different types of wringer mops.

As shown in FIGS. 1 and 2, the mop head 22 is connected to an operating rod 32 at the rod's lower connecting end 34. As shown in FIG. 1, the operating rod 32 extends upwardly through a longitudinal opening 35 in the handle's interior. This opening extends to the medial portion 36 of the handle. At the medial portion 36, the operating rod 32 bends outwardly and extends through a longitudinal slot 38 in the medial portion of the handle. There, the upper end 40 of the operating rod 32 connects to operating means 42.

Figure 7:
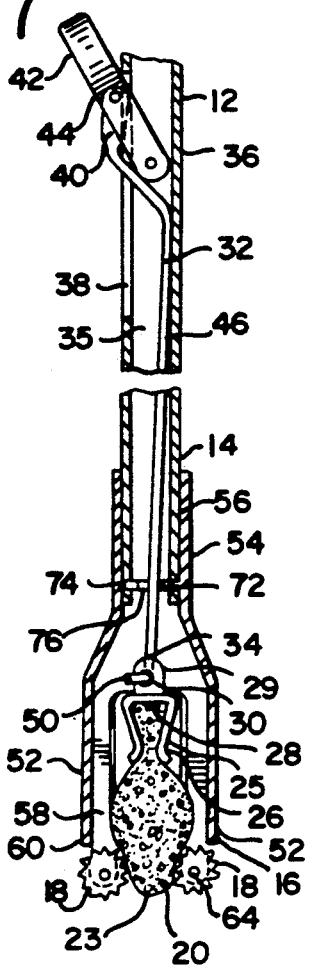
FIG. 7 is a side cross-sectional view of the wringer mop of the present invention, showing the operating rod and mop head in the wring out position.

As shown in FIG. 7, the operating means 42 allows for pulling the operating rod 32 upwardly, so that the connected mop head 22 is also pulled upwardly through the wringer rollers 18 to a wring out position. As the mop head is pulled upwardly, the wringer rollers compress the cleansing portion of the sponge, expelling fluid from the sponge.

Figure 6:
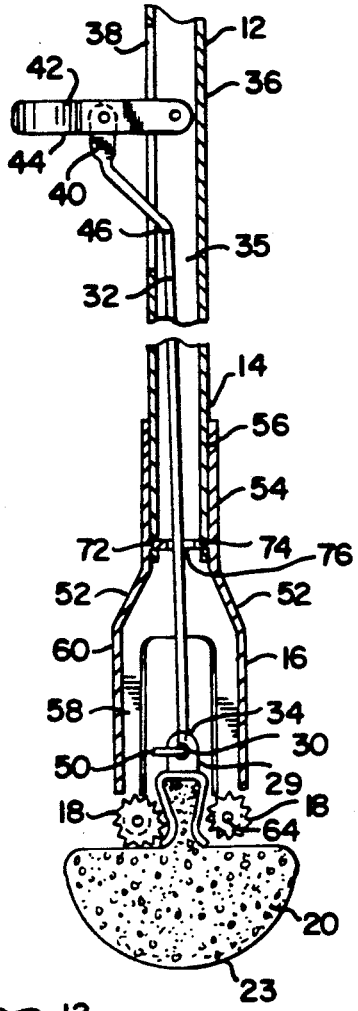
FIG. 6 is a side cross-sectional view of the wringer mop of the present invention, showing the operating rod and mop head in the working o cleansing position.

As shown in FIG. 6, the operating means 42 allows for positioning the operating rod at an intermediate cleansing position. In this position, the side walls 26 of the spine 25 are positioned between and held by the parallel sets of wringer rollers 18.

Figure 5:
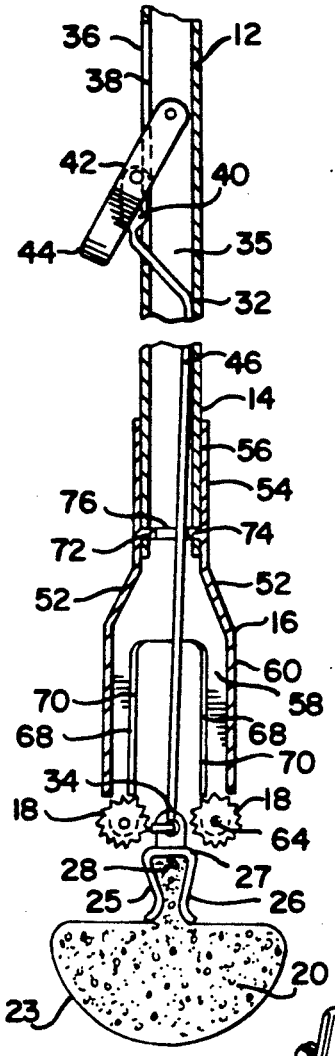
FIG. 5 is a side cross-sectional view of the wringer mop of the present invention, showing the operating rod in the mounting position.

As shown in FIG. 5, the operating means 42 allows for pushing the operating rod 32 downwardly to a mounting position where the connecting end 34 of the rod is disposed substantially between the sets of wringer rollers. In this position, the spine 25 is free from the sets of wringer rollers and the mop head 22 may be removed from the operating rod and replaced with a replacement mop head.

In the illustrated embodiment, the operating means 42 comprises an operating lever 44. As shown in FIG. 1, the operating lever extends through the longitudinal slot 38 in the handle 12 into the open area 35 of the handle's interior, where it is pivotably connected to the handle. The medial portion of the operating lever is pivotably connected to the upper end 40 of the operating rod. So constructed, the operating lever may be moved into the wring out, cleansing, and mounting positions, as shown in FIGS. 5 through 7.

Figure 3:
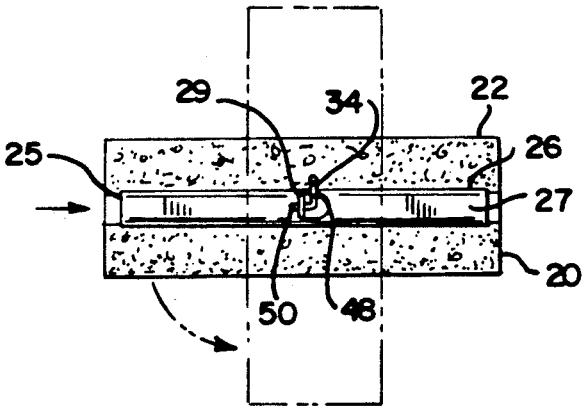
FIG. 3 is a top view of the mop head and part of the operating rod of the present invention, showing, in phantom lines, the turning of the mop head to mount it on the operating rod.

From its upper end the operating rod 32 extends downwardly through the open area 35 of the handle 12 in an elongate segment 46 to its lower connecting end 34. As shown in FIGS. 2 and 3, the connecting end 34 has an integral medial segment 48 bent from the elongate segment 46. The medial segment 48 is substantially parallel to the sets of wringer rollers 18. The medial segment 48 is integral with a terminating segment 50 of the connecting end. The terminating segment 50 is substantially perpendicular to the sets of wringer rollers 18.

The spine's mounting member 29 and the shape of the connecting end 34 of the operating rod 32 allow the mop head 22 to be mounted as shown in FIGS. 2 and 3. With the operating lever pushed downwardly, the operating rod is thereby pushed downwardly to the mounting position shown in FIG. 5. There, the connecting end 34 of the operating rod 32 is between the spaced sets of wringer rollers 18. To mount the mop head, the mop head 22 is placed perpendicularly to the sets of spaced wringer rollers 18, and the terminating segment 50 of the connecting end 34 of the operating rod 32 is inserted into the aperture of the spine's mounting member 29, as shown in FIG. 2. The mop head is then turned around its central vertical axis a quarter turn, until its longitudinal channel 28 is parallel to the sets of wringer rollers 18, as shown in phantom lines in FIG. 3. In so turning the mop head 22, the spine's mounting member 29 moves to the medial segment 48 of the connecting end 34 of the operating rod 32. With the mop head so disposed, the operating lever 44 is pulled to the cleansing position shown in FIG. 6; the operating rod 32 and mop head are thereby pulled upwardly into the housing 16 until the side walls 26 of the spine 25 are positioned between the sets of wringer rollers 18. In the cleansing position, the sets of wringer rollers prevent the mop head from turning, and thereby keep the mop head in place. The mop head ma be replaced by pushing the operating lever downwardly to the mounting position, where the mop head is free from the sets of wringer rollers; the mop head may then be turned about its central vertical axis and removed from the connecting end of the operating rod.

The mop head housing 16 comprises a pair of mating shells 52, each shell having an upper portion 54 defining a partial socket 56 for the captive retention of the lower end 14 of the mop handle 12 between the two shells. Each shell 52 has bifurcated end walls 58 separated by an integral side wall 60. The end walls 58 are: integral with the side wall; formed along the edges of the side wall; substantially perpendicular to the side wall 60; and are substantially parallel to each other. At their lower ends, the end walls 58 form apertured support legs 62. An axle 64 extends through the apertures of the support legs 62, and one set of wringer rollers 18 is mounted on the axle. In the illustrated embodiment, each set of wringer rollers includes three individual rollers 66, one between the support legs 62, and two on the ends of the axle adjacent to the support legs. The individual rollers 66 may have axial serrations around their surfaces to increase their gripping of the sponge 20.

Each shell 52 of the mop head housing 16 also has integral strengthening walls 68 integral with and disposed along the edges 70 of the end walls 58. In the illustrated embodiment the strengthening walls 68 are substantially perpendicular to the end walls 58. Together, the strengthening walls 68, end walls 58, and side wall 60 of each shell 52 define channel members, to strengthen the structure of the mop head housing. With the housing so strengthened, it may be used with larger sponges, and the lengths of the side walls and end walls may be increased, to increase the length of the path through which the sponge may be pulled during squeeze out of the sponge. Such a longer path may be desirable with larger sponge elements.

Figure 4:
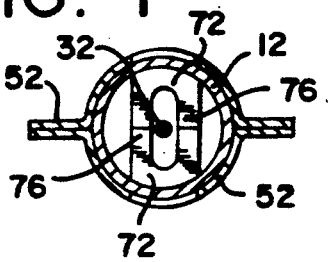
FIG. 4 is a cross-section taken along line 4—4 of FIG. 1, with parts omitted for clarity.

The illustrated mop head housing also includes a means for limiting the lateral movement of the operating rod within the handle. As shown in FIG. 4, each mating shell 52 of the mop head housing 16 has projections 72 extending from each shell into the longitudinal opening 35 in the handle 12. Each illustrated projection comprises a forked member integral with the upper portion 54 of the shell 52. The forked members are opposing, and extend through opposing transverse slots 74 near the lower end 14 of the mop handle. The operating rod 32 extends between the prongs 76 of the opposing forked members.

The illustrated mating shells 52 are each made of metal, and the projections are stamped out of the metal on three sides, and bent along their cases. With the projections 72 inserted into the transverse slots 74, the mating shells may then be secured to the mop handle 12 by rivets, nuts and bolts, or the like.

The illustrated mop may also include auxiliary cleaning elements. In using such mops, it is sometimes desirable to have convenient use of a squeegee, for cleaning wet areas and for window cleaning; it is also sometimes desirable to have use of a scrub brush attachment for cleaning heavily soiled areas. The illustrated mop provides attachable auxiliary cleaning elements on one side of the mop, for convenient use of these elements.

Figure 8:
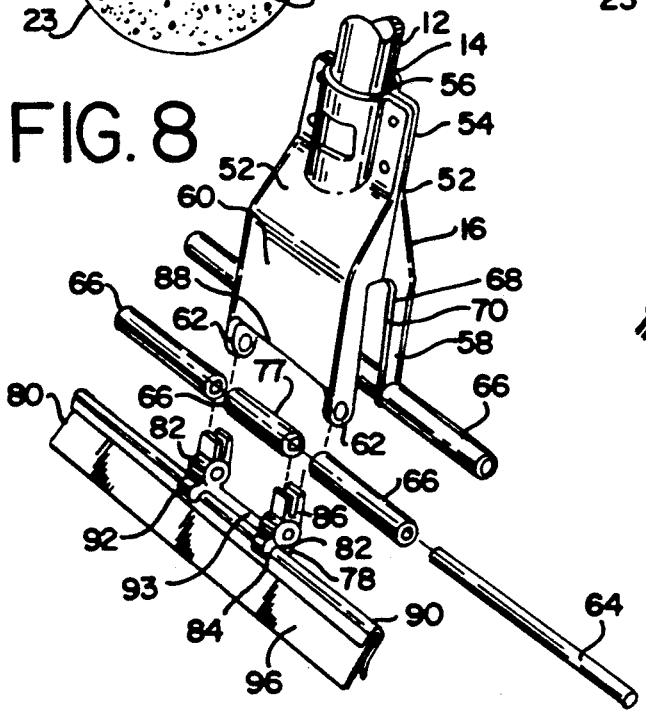
FIG. 8 is an exploded perspective view of the mop head housing, auxiliary squeegee attachment and mounting bracket.

As shown in FIG. 8, a bracket 78 for mounting the auxiliary cleaning element 80 is provided. The illustrated bracket 78 includes a pair of apertured members in the form of spaced rings 82 having coaxial apertures 84. In the illustrated embodiment, the rings 82 are spaced to fit between the support legs 62 of one of the mating shells 52. The bracket is mounted on the axle 64 associated with the shell 52, with the axle extending through the apertures 84 in the rings 82. The center wringer roller 77 fits between the two rings 82 on the axle, and its length is shorter than that of the other rollers to accommodate the width of the bracket's rings 82.

The bracket 78 also includes forked retaining members 86 to maintain the position of the bracket. The forked retaining members 86 capture the lower edge 88 of the shell's side wall 60 between their prongs. In the illustrated embodiment, two forked retaining members are disposed on and integral with the spaced rings 82 of the bracket 78.

Figure 9:
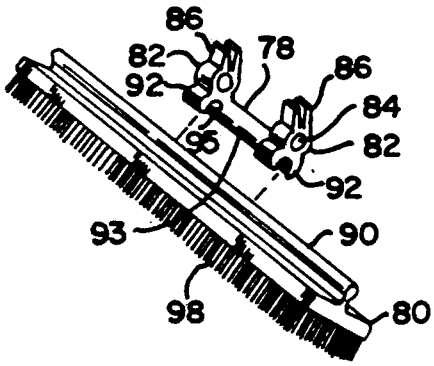
FIG. 9 is an exploded perspective view of an auxiliary brush attachment and mounting bracket.

The bracket also includes means for holding the auxiliary cleaning element. In the embodiment illustrated in FIGS. 8 and 9, the auxiliary cleaning element is demountably attached to the bracket. The auxiliary cleaning element 80 has an elongate spine 90 along the length of its back, and the means for holding the auxiliary cleaning element includes spaced arms 92 and an backing member 93, integral with the rings 82. Together, the arms 92 and backing member 93 define a channel 95 adapted to receive and hold the spine 90 of the auxiliary cleaning element. The spine 90 may be mounted on the bracket by sliding the spine 90 into the channel 95 between the arms 92 and the backing member 93. The spine 92 and channel 95 are shaped so that the spine is captured between the arms 92 and the backing member 93. The auxiliary cleaning element 80 may be similarly removed from the bracket by sliding the spine out of the channel 95. Thus, similarly shaped spines may be formed on the backs of a squeegee 96, a scrub brush 98, or other cleaning tool, so that the bracket may be used with interchangeable cleaning elements.

The illustrated bracket may be made of molded plastic or other material. The parts should preferably be formed so that the auxiliary cleaning element is held at an angle comfortable for use. In the illustrated embodiment, the angle between the backing member 93 and the retaining members 86 is approximately 142 degrees.

It will be understood by those skilled in the art that the illustrated bracket can be modified to be used with auxiliary cleaning elements that are not interchangeable. For example, the spaced rings 82 and retaining member 86 may be integral with the back of the cleaning element, in which case the means for holding the auxiliary cleaning element would include the back of the cleaning element integral with the rings and retaining member.

With the squeegee attachment, the illustrated mop has utility as a window cleaning apparatus. For such use, it may be desirable to provide a longer handle for reaching higher windows. Toward this end, the sponge mop may be provided with a handle extension. The extension may be a separate tube adapted to be attached to the end of the mop handle !2, or it may be adapted to fit telescopically within the handle, as the tube 100 shown in FIG. 1.

Thus, with the applicant's invention, it is possible to perform several cleaning operations with one sponge mop. It is also possible to construct a wringer mop of the type having an internal operating rod using the mop head housing structure to limit lateral movement of the rod within the handle, instead of inserting a separate piece within the handle to so limit movement. And, it is possible to simply mount and remove the mop head from the operating rod, utilizing the shape of the operating rod and the wringer rollers to keep the mop head in place when in use.

While in accordance with the United States Patent Statutes, a preferred embodiment of the invention has been shown and described, various changes may be made in the wringer mop with auxiliary cleaning elements of this invention, without departing from the true spirit and scope of the invention as set forth in the claims.

I claim:

1. A mop head housing for use with a wringer mop of the type having an elongate handle with a hollow interior and an elongate operating rod extending through the hollow interior of the handle, the mop head housing comprising a pair of mating shells, each shell including a projection extending from the shell, the two projections from the mating shells being adapted to project into the hollow interior of the mop handle to define a path through which the operating rod may extending to thereby limit the lateral movement of the operating rod.

2. A mop head housing as claimed in claim 1 wherein the projections comprise opposing forked members, the prongs of the forked members defining the path through which the operating rod may extend.

3. A mop head housing for use with a sponge mop of the type having sets of wringer rollers to expel fluid from the sponge, the mop head housing comprising a pair of mating shells having side walls and channel-defining walls along the edges of the side walls, said channel-defining walls including end walls disposed along the edges of the side walls and strengthening walls disposed along the edges of the end walls, the end walls being substantially orthogonal to the side walls and the strengthening walls being substantially orthogonal to the end walls.

4. A wringer mop comprising:

a. an elongate handle having a longitudinal opening within the handle's interior extending from the handle's medial portion to the lower end of the handle;

b. an elongate operating rod having an upper end disposed at the medial portion of the handle, an elongate segment extending downwardly from the upper end through the longitudinal opening in the interior of the handle and a lower connecting end, the lower connecting end of the operating rod defining a hook lying in a plane substantially perpendicular to the elongate segment of the operating rod;

c. a mop head housing fixed at the lower end of the mop handle, the mop head housing including:

1) a pair of mating shells, each shell having:

(a) an upper portion defining a partial socket for the captive retention of the lower end of the mop handle between the two shells; and (b) bifurcated end walls forming apertured support legs at their lower ends;

2) a set of parallel axles extending through the apertures of the support legs of the shells;

3) first and second sets of spaced wringer rollers supported on the axles of each shell, the two sets of spaced rollers being substantially parallel to each other and defining an elongate passageway therebetween;

d. a replaceable mop head including:

1) an elongate sponge;

2) an elongate spine disposed in the elongate passageway between the sets of spaced wringer rollers and defining a channel in which a portion of the elongate sponge is held, the elongate sponge having a portion exposed beyond the spine;

3) a mounting member having an apertured face extending upwardly from the spine and disposed substantially at the central vertical axis of the replaceable mop head, with the hook of the operating rod extending through the aperture to mount the mop head on the operating rod;

e. operating means associated with the upper end of the operating rod for pushing the rod downwardly for mounting and removing the mop head and for pulling the rod upwardly so that the exposed portion of the sponge is pulled between the set of spaced wringer rollers to compress the sponge.

5. A wringer mop as claimed in claim 4 wherein the hook end of the operating rod includes a medial segment integral with and substantially perpendicular to the elongate segment and a terminating segment integral with the medial segment, the terminating segment being substantially perpendicular to the medial segment and substantially parallel to the aperture face of the mounting member.

* * * * *

UNITED STATES PATENT AND TRADEMARK OFFICE

CERTIFICATE OF CORRECTION

PATENT NO. : 5,097,561

DATED : March 24, 1992

INVENTOR(S) : Bonifacio Torres

It is certified that error appears in the above-identified patent and that said Letters Patent is hereby corrected as shown below:

Column 2, line 4, "mo" should be --mop--;

Column 2, line 66, after "rod" insert --,--;

Column 3, line 29, "o" should be --or--; and

Column 8, line 53, "aperture" should be --apertured--.

Signed and Sealed this

Fifteenth Day of June, 1993

*Attest:*

*Attesting Officer*

Michael K. Kirk

MICHAEL K. KIRK

*Acting Commissioner of Patents and Trademarks*